US009320097B2

(12) United States Patent
Zhang et al.

(10) Patent No.: US 9,320,097 B2
(45) Date of Patent: Apr. 19, 2016

(54) MULTI-STRING DIMMABLE LED DRIVER

(71) Applicant: Marvell World Trade Ltd., St. Michael (BB)

(72) Inventors: Wanfeng Zhang, Palo Alto, CA (US); Pantas Sutardja, Los Gatos, CA (US)

(73) Assignee: MARVELL WORLD TRADE LTD., St. Michael (BB)

( * ) Notice: Subject to any disclaimer, the term of this patent is extended or adjusted under 35 U.S.C. 154(b) by 0 days.

(21) Appl. No.: 14/272,438

(22) Filed: May 7, 2014

(65) Prior Publication Data

US 2014/0333216 A1 Nov. 13, 2014

Related U.S. Application Data

(60) Provisional application No. 61/822,020, filed on May 10, 2013, provisional application No. 61/943,269, filed on Feb. 21, 2014.

(51) Int. Cl.
*H05B 37/02* (2006.01)
*H05B 33/08* (2006.01)

(52) U.S. Cl.
CPC ..... *H05B 33/0827* (2013.01)

(58) Field of Classification Search
CPC ... H05B 33/0815; H05B 37/02; H05B 39/042
USPC ..... 315/10, 11, 11.5, 185 R, 192, 291, 294, 315/297, 307–309
See application file for complete search history.

(56) References Cited

U.S. PATENT DOCUMENTS

| | | | | |
|---|---|---|---|---|
| 6,498,440 | B2 * | 12/2002 | Stam et al. | 315/291 |
| 7,733,034 | B2 * | 6/2010 | Kotikalapoodi et al. | 315/294 |
| 8,330,393 | B2 * | 12/2012 | Thomson et al. | 315/308 |
| 8,912,734 | B2 | 12/2014 | Melanson et al. | |
| 2004/0105264 | A1 * | 6/2004 | Spero | 362/276 |
| 2010/0110672 | A1 * | 5/2010 | Durand et al. | 362/231 |
| 2010/0259182 | A1 | 10/2010 | Man et al. | |
| 2011/0115407 | A1 * | 5/2011 | Wibben et al. | 315/294 |
| 2011/0234109 | A1 | 9/2011 | Chiu | |
| 2011/0309757 | A1 | 12/2011 | Weaver et al. | |
| 2013/0063035 | A1 | 3/2013 | Baddela et al. | |

OTHER PUBLICATIONS

Internal Search Report and Written Opinion for PCT/US2014/037215, filed on May 7, 2014.

* cited by examiner

*Primary Examiner* — Jason M Crawford

(57) ABSTRACT

An apparatus includes a first LED driver configured to control a first string of LEDs, a second LED driver configured to control a second string of LEDs, a third LED driver configured to control a third string of LEDs, and a control circuit configured to receive a control signal and to control the first, second, and third LED drivers so that the first, second, and third strings of LEDs cooperate in producing light according to the control signal and a color curve.

19 Claims, 5 Drawing Sheets

MULTI-STRING DIMMABLE LED DRIVER

CROSS REFERENCE TO RELATED APPLICATIONS

This present disclosure claims the benefit of U.S. Provisional Application No. 61/822,020, filed on May 10, 2013, and of U.S. Provisional Application No. 61/943,269, filed on Feb. 21, 2014, which are each incorporated by reference herein in their entirety.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Light-Emitting Diodes (LEDs) are semiconductor devices that convert electric current to light. A color of the light emitted by an LED is determined by an energy band gap of the semiconductor. The color may range from infrared (e.g., 940 nm wavelength) to ultraviolet (e.g. 210 nm wavelength).

LEDs emitting different colors of light may have different operating voltages. Furthermore, the relationship between current and light output power varies between different types and colors of LEDs, and may be nonlinear.

LEDs with energy band gaps that produce infrared, red, orange, yellow, green, blue, violet, and ultraviolet light have been developed. In addition, LEDs have been developed that illuminate a phosphor to create additional colors of light.

A plurality of different colors of light can be combined to produce other colors of light, including a white light. The "whiteness" of the white light produced is measured by correlating the produced white light to light emitted by a black body radiator of a given temperature to determine a Correlated Color Temperature (CCT). For example, light having a CCT of 2700° Kelvin (K) is considered "warm white," and sunlight has a CCT of 4500° K.

The amount of light emitted by an LED may be controlled by varying the magnitude of a current flowing through the LED. Reducing the current through an LED dims the LED, that is, lowers the amount of light emitted by the LED. An LED may also be dimmed by rapidly turning the LED on and off while varying a ratio of an on time to an off time of the LED, that is, by varying the duty cycle of the LED.

When light from a plurality of LEDs having different colors are combined, the resulting color of the light produced may vary as the plurality of LEDs are dimmed. Furthermore, manufacturing tolerances of LEDs and changes over time in LEDs may also cause the resulting color to vary.

SUMMARY

An embodiment of an apparatus includes a first LED driver configured to control a first string of LEDs, a second LED driver configured to control a second string of LEDs, a third LED driver configured to control a third string of LEDs, and a control circuit configured to receive a control signal and to control the first, second, and third LED drivers so that the first, second, and third strings of LEDs cooperate in producing light according to the control signal and a color curve.

In an embodiment, the color curve indicates light having a predetermined Correlated Color Temperature (CCT) when one or more of the strings of LEDs are dimmed. The color curve may indicate light having a Correlated Color Temperature (CCT) according to the luminance of the strings of LEDs. The first, second, and third LED drivers may be controlled so that the CCT of the luminance of the strings of LEDs substantially follows a black body curve.

In an embodiment, one or more of the first, second, and third LED drivers is configured to control duty cycles of currents of the respective strings of LEDs. The one or more of the first, second, and third LED drivers may be configured to control magnitudes of the currents of the respective strings of LEDs. The one or more of the first, second, and third LED drivers may be configured to control the magnitudes using a linear mode. The one or more LED drivers may be configured to control the duty cycles of the currents of the respective strings of LEDs when in a first mode, and configured to control the magnitudes of the currents of the respective strings of LEDs when in a second mode. The second mode may be a linear mode. The first LED driver may be configured to operate a buck converter for controlling the first string of LEDs.

In an embodiment, the apparatus further includes a sensor circuit configured to sense the current of one or more of the first, second, and third strings of LEDs.

In an embodiment, the color curve may indicate ratios of the currents of the first, second, and third strings of LEDs.

In an embodiment, the control circuit is configured to receive a color sense signal and to control the first, second, and third LED drivers according to the control signal, the color curve, and the color sense signal.

In an embodiment, a single integrated circuit includes the apparatus.

An embodiment of a method of controlling a plurality strings of LEDs in a multi-string LED driver comprises receiving a control signal, determining a target value according to the control signal and a color curve, and controlling an LED driver according to the target value so that the plurality of LED strings cooperate in producing light according to the control signal and the color curve. The LED driver is one of first through third LED drivers of the multi-string LED driver.

In an embodiment of the method, the color curve indicates light having a Correlated Color Temperature (CCT) according to the luminance of the strings of LEDs. The first, second, and third LED drivers may be controlled so that the CCT of the luminance of the strings of LEDs substantially follows a black body curve.

In an embodiment, the method further comprises controlling a duty cycle of a current of a string of LEDs of the plurality of strings of LEDs. The method may further comprise controlling a magnitude of the current of the string of LEDs. The method may further comprise controlling the duty cycle of the current when the LED driver is in a first mode, and controlling the magnitude of the current when the LED driver is in a second mode.

In an embodiment, the method further comprises sensing a current of one or more of the first, second, and third strings of LEDs and controlling the LED driver according to the sensed current.

In an embodiment, the method further comprises receiving a color sense signal and determining the target value according to the color sense signal, the control signal, and the color curve.

DETAILED DESCRIPTION

Figure 1:
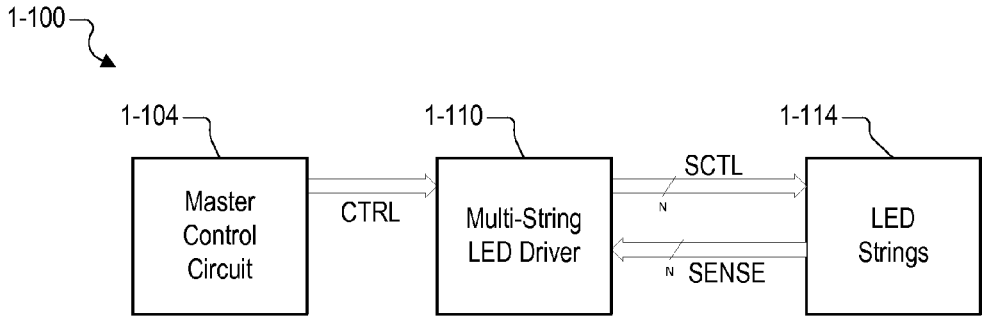
FIG. 1 is a block diagram of an LED illumination system including a multi-string LED driver according to embodiments of the disclosure.

FIG. 1 shows a LED illumination system 1-100 including a master control circuit 1-104, a plurality of LED strings 1-114, and a multi-string LED driver 1-110 according to embodiments of the disclosure. The master control circuit 1-104 transmits master control signals CTRL to the multi-string LED driver 1-110.

The multi-string LED driver 1-110 receives the master control signals CTRL and controls currents in the plurality of LED strings 1-114 based thereon. The multi-string LED driver 1-110 modulates the currents in the plurality of LED strings 1-114 by modulating the string control signals SCTL and by sensing the current in the LED string using the current sense signals SENSE. The multi-string LED driver 1-110 modulates the string control signals SCTL by controlling a duty cycle of each of the string control signals SCTL, a magnitude of each of the string control signals SCTL, or a combination thereof.

The multi-string LED driver 1-110 also includes a color curve, and uses the color curve to control the currents in the plurality of LED strings 1-114. The color curve may include ratios between the currents, which may vary according to the amount of illumination produced by the plurality of LED strings 1-114.

Figure 2:
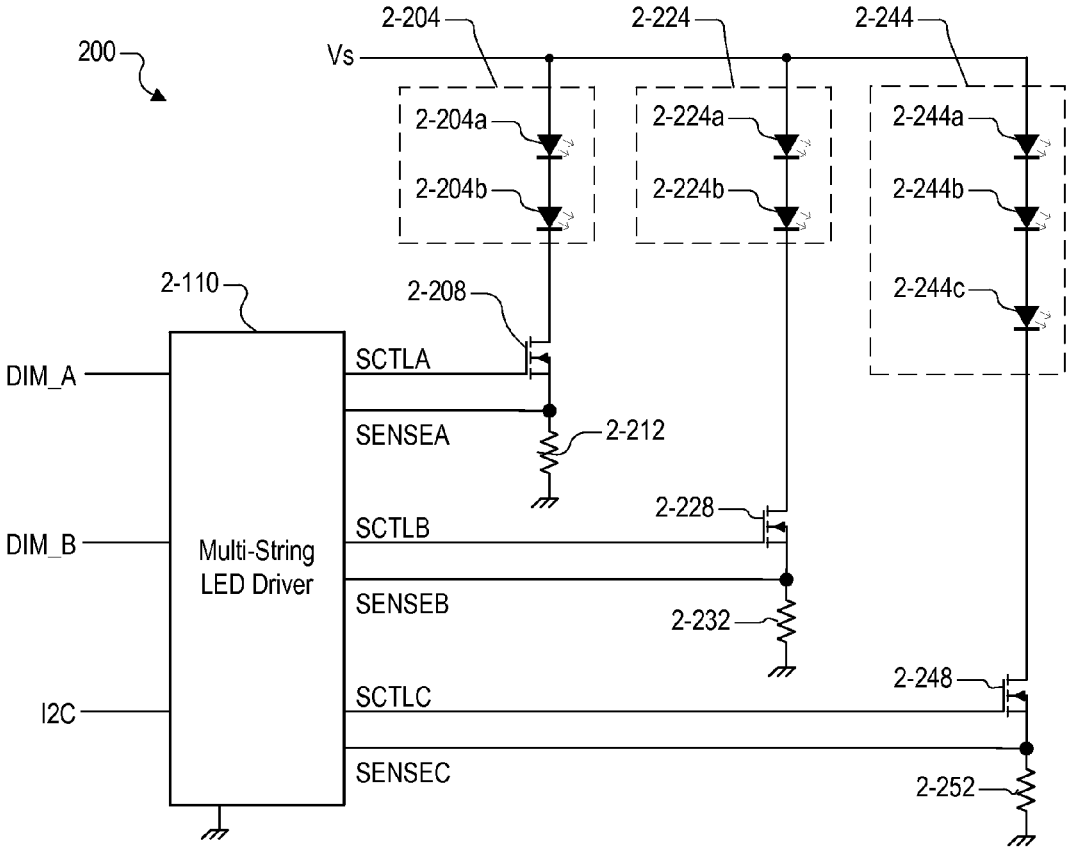
FIGS. 2 and 3 illustrate LED lighting circuits including a multi-string LED driver according to a first embodiment.

FIG. 2 illustrates a first LED lighting circuit 200 including a multi-string LED driver 2-110 according to an embodiment suitable for use as the multi-string LED driver 1-110 of FIG. 1. The multi-string LED driver 2-110 receives first and second dimmer signals DIM_A and DIM_B and an Inter-Integrated Circuit (I2C) signal I2C. In an embodiment, the I2C signal I2C may be a System Management Bus (SMB) signal, a Universal Serial Bus (USB) signal, a High Speed Inter Chip (HSIC) signal, or other suitable digital communication bus signal.

A first string control signal SCTLA is generated by the multi-string LED driver 2-110 and is transmitted to a gate terminal of a first transistor 2-208. A source terminal of the first transistor 2-208 is connected to a first end of a first LED string 2-204. The first LED string 2-204 includes a first first-color LED 2-204*a* and a second first-color LED 2-204*b*. A second end of the first LED string 2-204 is connected to a supply voltage Vs.

A drain terminal of the first transistor 2-208 is connected to a first end of a first resistor 2-212 and to a first current sense input SENSEA of the multi-string LED driver 2-110. A second end of the first resistor 2-212 is connected to ground. A voltage across the first resistor 2-212 corresponds to a current flowing through the first LED string 2-204.

In a first string control mode, the multi-string LED driver 2-110 controls the current flowing through the first LED string 2-204 by controlling a magnitude of a voltage of the first string control signal SCTLA until a voltage of the first current sense input SENSEA has a predetermined value. The first string control mode may be a linear mode.

In a second string control mode, the multi-string LED driver 2-110 controls the current flowing through the first LED string 2-204 by turning the first transistor 2-208 on and off using the first string control signal SCTLA, thereby controlling a duty cycle of the current flowing through the first LED string 2-204. The second string control mode may be a Pulse Width Modulation (PWM) mode. In an embodiment, the multi-string LED driver 2-110 determines an average current flowing through the first LED string 2-204 using signals received through the first current sense input SENSEA.

Second and third string control signal SCTLB and SCTLC are generated by the multi-string LED driver 2-110 and are transmitted to gate terminals of second and third transistors 2-228 and 2-248, respectively. Source terminals of the second and third transistors 2-228 and 2-248 are connected to first ends of second and third LED strings 2-224 and 2-244, respectively. Second ends of the second and third LED strings 2-224 and 2-244 are connected to the supply voltage Vs.

Figure 5:
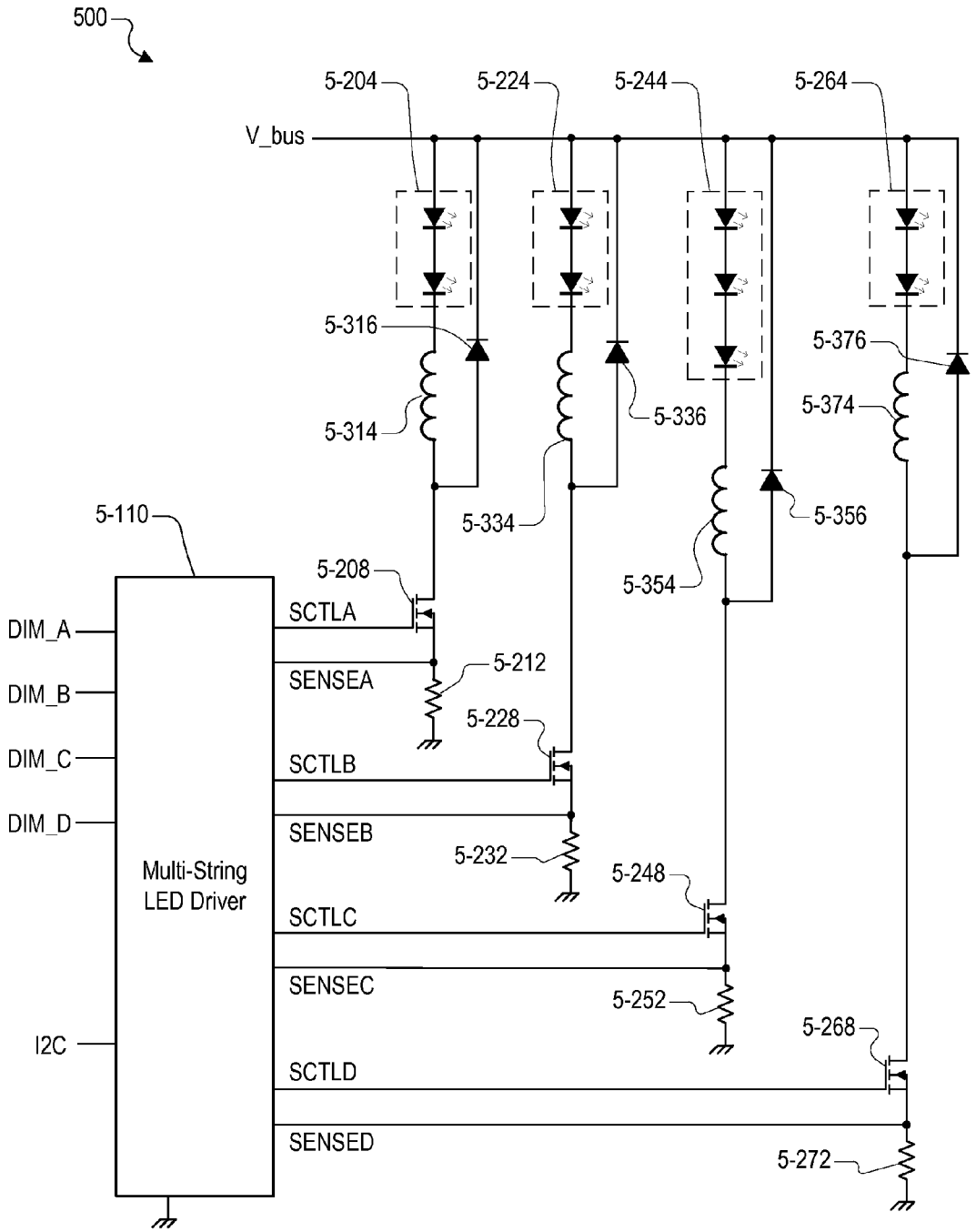
FIG. 5 illustrates an LED lighting circuit including a multi-string LED driver according to a second embodiment.

The second LED string 2-224 includes first and second second-color LEDs 2-224*a* and 2-224*b*. The third LED string 2-244 includes first through third third-color LEDs 2-244*a* through 2-224*c*. While FIG. 5 shows the first through third LED strings 2-204 through 2-244 including two, two, and three LEDs, respectively, each of the first through third LED strings 2-204 through 2-244 may include any number of LEDs.

Each of the first, second, and third LED strings 2-204, 2-224, and 2-244 include one or more LEDs emitting the same color. The first LED string, second, and third LED strings 2-204, 2-224, and 2-244 may, respectively, include red, green, and blue LEDs, amber, white, and blue LEDs, or amber, white, and yellow LEDs, and so on.

In an embodiment, the colors of the first through third LED strings 2-204 through 2-244 are selected so that the light produced thereby follows a selected color curve, such as a black body curve, when dimmed. Such control of the color of the light produced is not easy in lighting systems using only one or two strings of LEDs.

Drain terminals of the second and third transistors 2-228 and 2-248 are connected to first ends of second and third resistors 2-232 and 2-252 and to second and third current sense inputs SENSEB and SENSEC of the multi-string LED driver 2-110, respectively. Second ends of the second and third resistors 2-232 and 2-252 are connected to ground. Voltages across the second and third resistors 2-232 and 2-252 correspond to currents flowing through the second and third LED strings 2-224 and 2-244, respectively.

Each of the currents flowing through the second and third LED strings 2-224 and 2-244 may be controlled by the multi-string LED driver 2-110 using either of the first or second string control modes described above with respect to the first LED string 2-204. The string control mode used for each of the first through third LED strings 2-204 through 2-244 may be independent of the string control mode used for the other LED strings.

The first through third transistors 2-208 through 2-248 are shown as a Metal Oxide Semiconductor Field Effect Transistors (MOSFETs), but may be junction FETs, bipolar junction transistors, insulated-gate bipolar transistors, or similar devices or circuits.

In a first configuration, the multi-string LED driver 2-110 controls the first LED string 2-204 according to the first dimmer signal DIM_A, and controls the second and third LED strings 2-224 and 2-244 according to the first dimmer signal DIM_A and a color curve of the multi-string LED driver 2-110.

In a second configuration, the multi-string LED driver 2-110 controls the first LED string 2-204 according to the first dimmer signal DIM_A, controls the second LED string 2-224 according to the second dimmer signal DIM_B, and controls a third LED string 2-244 according to the first dimmer signal DIM_A, the second dimmer signal DIM_B, and a color curve of the multi-string LED driver 2-110.

In a third configuration, the multi-string LED driver 2-110 controls the first through third LED strings 2-204 through 2-244 according to an I2C signal I2C and a color curve of the multi-string LED driver 2-110.

A color curve may comprise ratios between currents flowing through the first through third LED strings 2-204 through 2-244. The ratios between the currents may vary according to the amount of illumination produced by the first through third LED strings 2-204 through 2-244.

A color curve may also produce light from the first through third LED strings 2-204 through 2-244 that follows a black body curve. That is, the light produced by the first through third LED strings 2-204 through 2-244 according to the color curve may have a range of Correlated Color Temperature (CCT) values according to a range of luminance values, and may thereby emulate light produced by a predetermined black body radiator as a temperature of the black body radiator is varied. The produced light may have a CCT of 2200° K (i.e., candlelight) when the light produced has a minimum luminance, and the CCT of the produced light may increase to 5800° K (i.e., sunlight) as the luminance of the light produced increases to a maximum luminance.

Another color curve may produce light from the first through third LED strings 2-204 through 2-244 that maintains a substantially constant CCT as the luminance of the light produced varies. In an embodiment, the ratios between the currents flowing through the first through third LED strings 2-204 through 2-244 are varied according to the luminance of the light produced in order to maintain the constant CCT.

In an embodiment, a color curve is predetermined by the design of the multi-string LED driver 2-110. In an embodiment, a color curve is determined during a calibration procedure. In an embodiment, a color curve may be provided to the multi-string LED driver 2-110 using an I2C signal I2C. The provided color curve may be stored in volatile or nonvolatile memory within the multi-string LED driver 2-110.

The multi-string LED driver 2-110 may include a plurality of color curves. A color curve used for controlling the first through third LED strings 2-204 through 2-244 may be selected from among the plurality of color curves according to an I2C signal I2C, during a calibration procedure, or during a manufacturing step.

Figure 3:
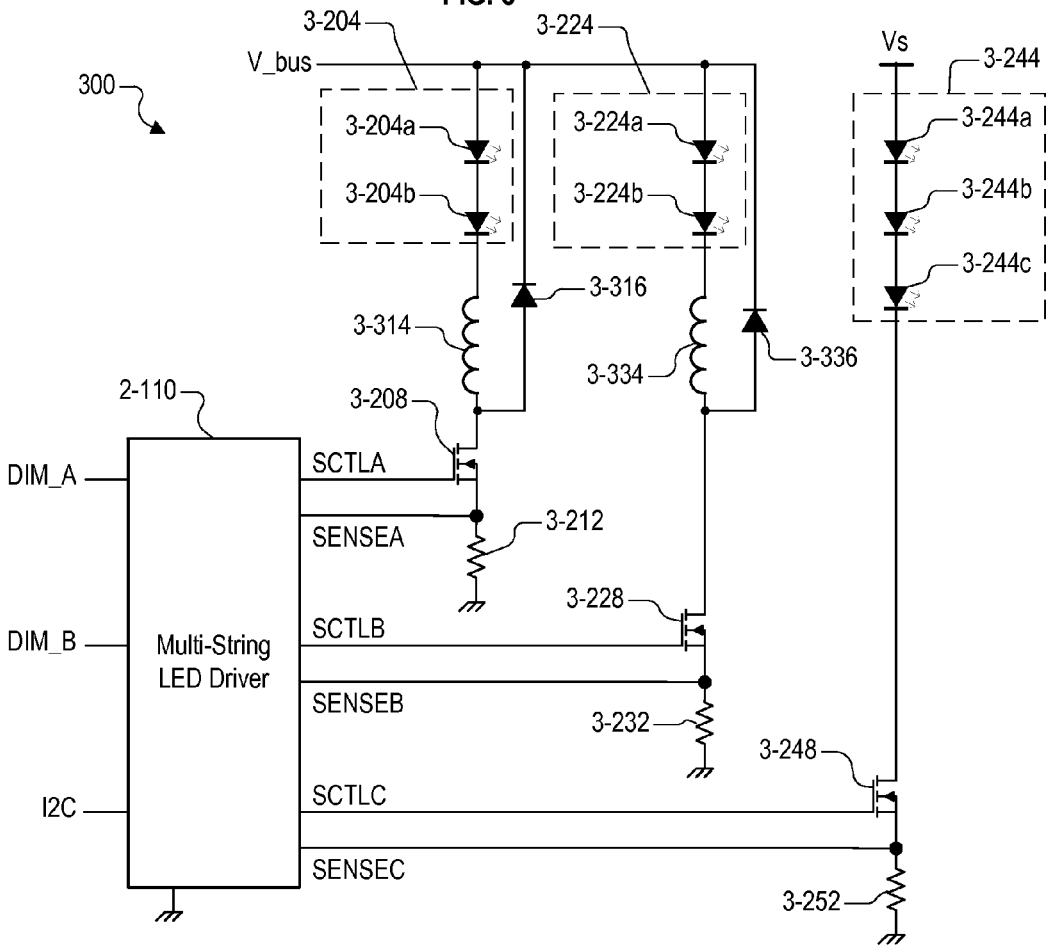

FIG. 3 illustrates a second LED lighting circuit 300 including the multi-string LED driver 2-110 configured to operate with buck converters. FIG. 3 differs from FIG. 2 in that the first and second LED strings 3-204 and 3-224 of FIG. 3 are controlled using buck converters.

The first string control signal SCTLA generated by the multi-string LED driver 2-110 is connected to a gate terminal of a first transistor 3-208. A source terminal of the first transistor 3-208 is connected to a first terminal of a first inductor 3-314 and to a first terminal of a first diode 3-316. A second terminal of the first inductor 3-314 is connected to a first end of a first LED string 3-204. The first LED string 3-204 includes a first first-color LED 3-204*a* and a second first-color LED 3-204*b*. A second end of the first LED string 3-204 and a second end of the first diode 3-316 are connected to a voltage bus V_bus.

A drain terminal of the first transistor 3-208 is connected to a first end of a first resistor 3-212 and to a first current sense input SENSEA of the multi-string LED driver 2-110. A second end of the first resistor 3-212 is connected to ground. A voltage across the first resistor 3-212 corresponds to a current flowing through the first LED string 3-204, first inductor 3-314, and first transistor 3-208.

A current flowing through the first LED string 3-204 is controlled by the multi-string LED driver 2-110 using the second string control mode described above with respect to the first LED string 2-204 of FIG. 2. That is, the multi-string LED driver 2-110 controls the current flowing through the first LED string 3-204 by turning the first transistor 3-208 on and off using the first string control signal SCTLA. The second string control mode may be a Pulse Width Modulation (PWM) mode.

When the first transistor 3-208 is on, current flows through the first LED string 3-204, the first inductor 3-314, the first transistor 3-208, and the first resistor 3-212, and energy is stored into the first inductor 3-314. A back Electro-Motive Force (back EMF) of the first inductor 3-314 generates a current across the first inductor 3-314 according to the amount of energy stored in the first inductor 3-314.

When the first transistor 3-208 is off and a voltage generated by the energy stored in the first inductor 3-314 is greater than the combined forward voltage drops of the first LED string 3-204 and the first diode 3-316, current flows through the first LED string 3-204 and the first diode 3-316, extracting energy from the first inductor 3-314. As the energy stored in the first inductor 3-314 decreases, the current generated by the energy stored in the first inductor 3-314 decreases.

The amount of energy stored into and extracted from the first inductor 3-314 determines an average current flowing through the first LED string 3-204. Using the second string control mode, the multi-string LED driver 2-110 controls the amount of energy stored into and extracted from the first inductor 3-314 by controlling the on and off durations of the first transistor 3-208. In an embodiment, the multi-string LED driver 3-110 determines the energy stored into the first inductor 3-314 using signals received through the first current sense input SENSEA.

A second string control signal SCTLB generated by the multi-string LED driver 2-110 is connected to a gate terminal of a second transistor 3-228. A source terminal of the second transistor 3-228 is connected to a first terminal of a second inductor 3-334 and to a first terminal of a second diode 3-336. A second terminal of the second inductor 3-334 is connected to a first end of a second LED string 3-224. The second LED string 3-224 includes a first second-color LED 3-224*a* and a second second-color LED 3-224*b*. A second end of the second LED string 3-224 and a second end of the second diode 3-336 are connected to a bus voltage V_bus.

A drain terminal of the second transistor 3-228 is connected to a first end of a second resistor 3-232 and to a second current sense input SENSEA of the multi-string LED driver 2-110. A second end of the second resistor 3-232 is connected to ground. A voltage across the second resistor 3-232 corresponds to a current flowing through the second LED string 3-228, second inductor 3-334, and second transistor 3-228.

The multi-string LED driver 2-110 controls the second LED string 3-224 as described for the first LED string 3-204, above. In an embodiment, either or both buck converters used with the first and second LED strings 3-204 and 3-224 may be implemented using source switching.

The multi-string LED driver 2-110 controls a current flowing through the third LED string 3-244 as described for the third LED string 2-244 of FIG. 2. That is, the current flowing through the third LED string 3-244 may be controlled using the either the first or second string control mode. In another LED lighting circuit (not shown), the third LED string 3-244 may be coupled to a third inductor and a third diode such that the third LED string 3-244 is controlled using a buck converter, as described for the first LED string 3-204, above.

In a first configuration, the multi-string LED driver 2-110 controls the first LED string 3-204 according to the first dimmer signal DIM_A, and controls the second and third LED strings 3-224 and 3-244 according to the first dimmer signal DIM_A and a color curve of the multi-string LED driver 2-110. In a second configuration, the multi-string LED driver 2-110 controls the first and second LED strings 3-204 and 3-224 according the first and second dimmer signals DIM_A and DIM_B, respectively, and controls the third LED string 3-244 according to the first and second dimmer signals DIM_A and DIM_B and the color curve. In a third configuration, the multi-string LED driver 3-110 controls the first through third LED strings 3-204 through 3-244 according to an I2C signal I2C and the color curve.

A color curve may comprise ratios between currents flowing through the first through third LED strings 3-204 through 3-244. The ratios between the currents may vary according to the amount of illumination produced by the first through third LED strings 3-204 through 3-244.

A color curve may be used to produce light from the first through third LED strings 3-204 through 3-244 that follows a black body curve. Another color curve may produce light from the first through third LED strings 3-204 through 3-244 that maintains a constant CCT as the luminance of the light produced varies.

The multi-string LED driver 2-110 may include a plurality of color curves. A color curve used to control the first through third LED strings 3-204 through 3-244 may be selected from among the plurality of color curves according to an I2C signal I2C, during a calibration procedure, or during a manufacturing step.

Figure 4:
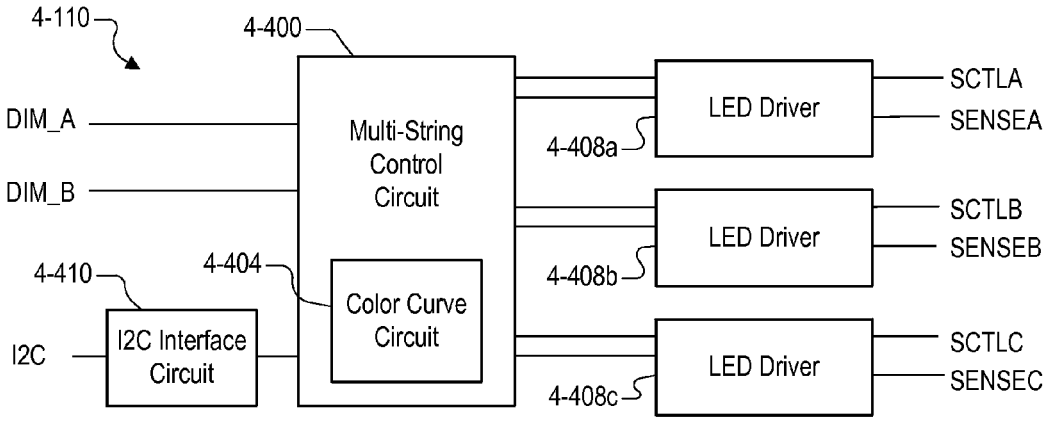
FIG. 4 is a block diagram of a multi-string LED driver according to the first embodiment.

FIG. 4 is a block diagram of the multi-string LED driver 4-110 suitable for use as the multi-string LED driver 2-110 of FIGS. 2 and 3, according to an embodiment. The multi-string LED driver 4-110 includes a multi-string control circuit 4-400 that controls first through third LED drivers 4-408*a* through 4-408*c*. The first through third LED drivers 4-408*a* through 4-408*c* are configured to control currents through first through third LED strings, respectively.

The multi-string control circuit 4-400 receives first and second dimmer signals DIM_A and DIM B, and also receives an I2C signal I2C through I2C interface circuit 4-410. The first and second dimmer signals DIM_A and DIM_B each correspond to a target luminance of one or more of the first through third LED strings and may be analog signals, pulse-width modulated (PWM) signals, or multi-bit digital signals.

The I2C signal I2C may be a multi-bit digital signal corresponding to a target luminance of one or more of the first through third LED strings, a string control mode setting for one or more of the first through third LED drivers 4-408*a* through 4-408*c*, a configuration setting for the multi-string control circuit 4-400, a color curve to be stored in the multi-string control circuit 4-400, a color curve selection, and so on.

The first through third LED drivers 4-408*a* through 4-408*c* are configured to control the first through third LED strings using first through third string control signals SCTLA through SCTLC, according to control signals received from the multi-string control circuit 4-400 and signals received through the first through third current sense inputs SENSEA through SENSEC, respectively. The first through third LED drivers 4-408*a* through 4-408*c* control the first through third LED strings by varying an amplitude of or by Pulse Width Modulation (PWM) of the first through third string control signals SCTLA through SCTLC.

The multi-string control circuit 4-400 includes a color curve circuit 4-404 configured to produce target values for one or more of the first through third LED strings according to one or more dimming signals and a color curve. The target values are such that the first through third LED strings produce light having a luminance according to the one or more dimming signals and a CCT, which corresponds to the CCT of the color curve at the produced luminance. A target value may indicate one or more of a current in one of the first through third LED strings, a current ratio between two of the first through third LED strings, a duty cycle of one of the first through third LED strings, and the like.

The color curve circuit 4-404 may be configured to produce target values using a look-up table (LUT) including a plurality of entries, each entry mapping one or more luminance values to target values for the first through third LED strings according to a color curve. The color curve circuit 4-404 may produce the target values by interpolating between entries in the LUT.

The one or more luminance values used to determine the target values may be a luminance value of combined light produced by the three LED strings, a luminance value of light produced by the first LED string, first and second luminance values of light produced by the first and second LED strings, and so on. A luminance value may indicate an absolute luminance values (e.g., "600 lumens"), a fraction of a maximum output (e.g., "50% of maximum luminance"), or may indicate a current in an LED string (e.g., "500 milliamps").

The entries in the LUT may correspond to a plurality of color curves which may be selected for use. The entries of the LUT may be stored in volatile or nonvolatile memory. Entries may be stored into the LUT according to an I2C signal I2C.

The color curve circuit 4-404 may be configured to produce the target values using an equation set comprising one or more of equations defining a color curve. The equation set may determine target values of the first through third LED strings according to luminance values.

The color curve circuit 4-404 may select the equation set to use from a plurality of equations sets embodied within the color curve circuit 4-404. The equation set may be embodied in a sequence of computer programming instructions, or may be embodied in parameters used to configure a circuit or as parameters provided to a processor executing a sequence of computer programming instructions. An equation set may be incorporated into the color curve circuit 4-404 during the design of the color curve circuit 4-404, during a manufacturing process, during a calibration process, or by an I2C signals I2C.

The color curve circuit 4-404 may include one or more processors, such as one or more of a general purpose processor, a special purpose processor, and a digital signal processor, which may be used to produce the target values. The one or more processors may execute computer programming instructions stored in a non-transitory computer-readable medium.

The multi-string control circuit 4-400 provides dimmer signals to the color curve circuit 4-404 and receives corresponding target values therefrom. The multi-string control circuit 4-400 controls the first through third LED drivers 4-408*a* through 4-408*c* according to their respective target values.

FIG. 5 illustrates a third LED lighting circuit 500 including a multi-string LED driver 5-110 according to an embodiment suitable for use as the multi-string LED driver 1-110 of FIG. 1. The multi-string LED driver 5-110 receives first through fourth dimmer signals DIM_A through DIM_D and an I2C signal I2C. In an embodiment, the I2C signal I2C may instead be a System Management Bus (SMB) signal, a Universal Serial Bus (USB) signal, a High Speed Inter Chip (HSIC) signal, or other suitable digital communication bus signal.

First through fourth string control signals SCTLA through SCTLD generated by the multi-string LED driver 5-110 are connected to gate terminals of first through fourth transistors 5-208 through 5-268, respectively. Source terminals of the first through fourth transistors 5-208 through 5-268 are connected to first terminals of first through fourth inductors 5-314 through 5-374 and to first terminals of first through fourth diodes 5-316 through 5-376, respectively. Second terminals of the first through fourth inductors 5-314 through 5-374 are connected to first ends of first through fourth LED strings 5-204 through 5-264, respectively. Second ends of the first through fourth LED strings 5-204 through 5-264 and second ends of the first through fourth diodes 5-316 through 5-376 are connected to a voltage bus V_bus.

Drain terminals of the first through fourth transistors 5-208 through 5-268 are connected to first ends of first through fourth resistors 5-212 through 5-272 and to first through fourth current sense inputs SENSEA through SENSED of the multi-string LED driver 5-110, respectively. Second ends of the first through fourth resistors 5-212 through 5-272 are connected to ground. Voltages across the first through fourth resistors 5-212 through 5-272 correspond to currents flowing through the first through fourth LED strings 5-204 through 5-264, first through fourth inductors 5-314 through 5-374, and first through fourth transistors 5-208 through 5-268, respectively.

Currents flowing through the first through fourth LED strings 5-204 through 5-264 are controlled by the multi-string LED driver 5-110 using a PWM mode and a buck converter as described in relation to the first LED string 3-204 of FIG. 3.

FIG. 5 shows the multi-string LED driver 5-110 controlling each of the first through fourth LED strings 5-204 through 5-264 using a buck converter circuit. In another lighting circuit including the multi-string LED driver 5-110, any or all of the LED strings may be controlled as described in relation to the first LED string 2-204 of FIG. 2. A person of skill in the art in light of the teachings and disclosures herein would understand how to modify the LED lighting circuit 500 to control one or more of the LED strings using a linear mode of the multi-string LED driver 5-110. When an LED string is controlled using the linear mode, the inductor and diode shown associated with the LED string in FIG. 5 may be omitted.

The first through fourth transistors 5-208 through 5-268 are shown as a Metal Oxide Semiconductor Field Effect Transistors (MOSFETs), but may be junction FETs, bipolar junction transistors, insulated-gate bipolar transistors, or similar devices or circuits. The first through fourth LED strings 5-204 through 5-264 are shown as including two, two, three, and two LEDs, respectively, but may include any number of LEDs.

In a first configuration, the multi-string LED driver 5-110 controls the first LED string 5-204 according to the first dimmer signal DIM_A, and controls the second through fourth LED strings 5-224 and 5-264 according to the first dimmer signal DIM_A and a color curve of the multi-string LED driver 5-110.

In a second configuration, the multi-string LED driver 5-110 controls the first LED string 5-204 according to the first dimmer signal DIM_A, controls the second LED string 5-224 according to the second dimmer signal DIM_B, and controls the third and fourth LED strings 5-244 and 5-264 according to the first dimmer signal DIM_A, the second dimmer signal DIM_B, and a color curve of the multi-string LED driver 5-110.

In a third configuration, the multi-string LED driver 5-110 controls the first LED string 5-204 according to the first dimmer signal DIM_A, controls the second LED string 5-224 according to the second dimmer signal DIM_B, controls the third LED string 5-244 according to the third dimmer signal DIMS, and controls the fourth LED string 5-264 according to the first through third dimmer signals DIM_A through DIM_C and a color curve of the multi-string LED driver 5-110.

In a fourth configuration, the multi-string LED driver 5-110 controls the first LED string 5-204 according to the first dimmer signal DIM_A, controls the second LED string 5-224 according to the second dimmer signal DIM_B, controls the third LED string 5-244 according to the third dimmer signal DIM_C, and controls the fourth LED string 5-264 according to the fourth dimmer signal DIM_D. In the fourth configuration, a color curve of the multi-string LED driver 5-110 is not used to control the first through fourth LED strings 5-204 through 5-264.

In a fifth configuration, the multi-string LED driver 5-110 controls the first LED string 5-204 according to the first dimmer signal DIM_A, controls the second LED string 5-224 according to the second dimmer signal DIM_B, controls the third LED string 5-244 according to the third dimmer signal DIM_C, and controls the fourth LED string 5-264 according to the fourth dimmer signal DIM_D, and a color curve of the multi-string LED driver 5-110 is used to adjust values generated according to the first through fourth dimmer signals DIM_A through DIM_D so that a light produced by the first through fourth LED strings 5-204 through 5-264 follows the color curve.

In a sixth configuration, the multi-string LED driver 5-110 controls the first through fourth LED strings 5-204 through 5-264 according to an I2C signal I2C and a color curve of the multi-string LED driver 5-110.

A color curve may comprise ratios between currents flowing through the first through fourth LED strings 5-204 through 5-264. The ratios may vary according to a luminance of the light produced by the first through fourth LED strings 5-204 through 5-264.

A color curve may also produce light from the first through fourth LED strings 5-204 through 5-264 that follows a black body curve. That is, the light produced by the first through fourth LED strings 5-204 through 5-264 according to the color curve may have a range of CCT values according to a range of luminance values, and may thereby emulate light produced by a predetermined black body radiator as a temperature of the black body radiator is varied. The produced light may have a CCT of 2200° K (i.e., candlelight) when the light produced has a minimum luminance, and the CCT of the produced light may increase to 5800° K (i.e., sunlight) as the luminance of the light produced increases to a maximum luminance.

Another color curve may produce light from the first through fourth LED strings 5-204 through 5-264 that maintains a substantially constant CCT as the luminance of the light produced varies. In an embodiment, the ratios between the currents flowing through the first through fourth LED strings 5-204 through 5-264 are varied according to the luminance of the light produced in order to maintain the substantially constant CCT.

In an embodiment, a color curve is predetermined by the design of the multi-string LED driver 5-110. In another embodiment, a color curve is determined during a calibration procedure. In another embodiment, a color curve may be input into the multi-string LED driver 5-110 using an I2C signal I2C and stored in volatile or nonvolatile memory within the multi-string LED driver 5-110.

The multi-string LED driver 5-110 may include a plurality of color curves. The color curve used to control the first through fourth LED strings 5-204 through 5-264 may be selected from among the plurality of color curves according to an I2C signal I2C, during a calibration procedure, or during a manufacturing step.

Figure 6:
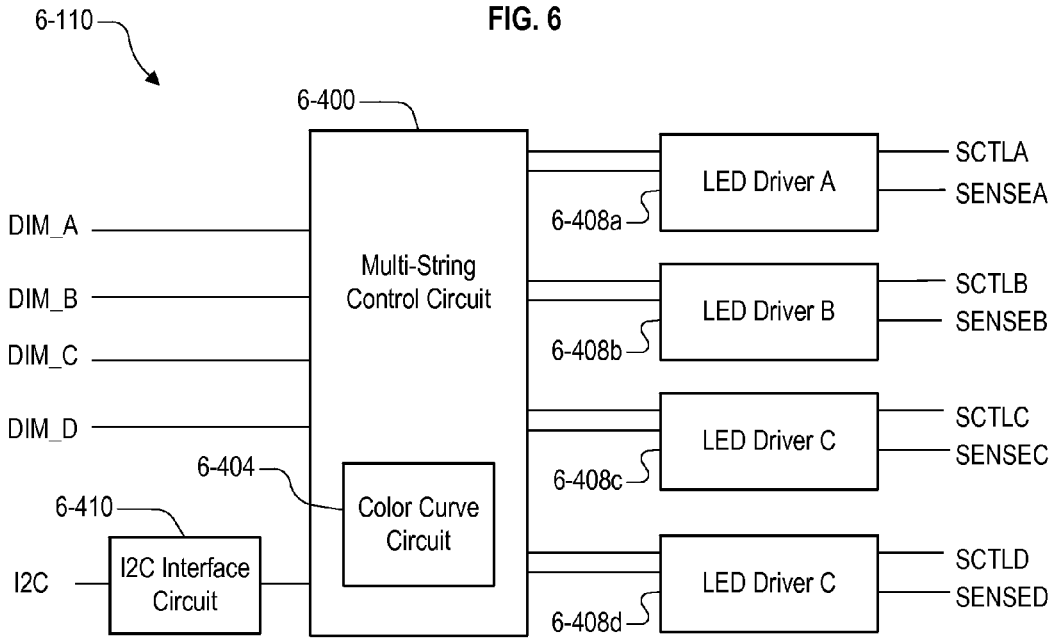
FIG. 6 is a block diagram of a multi-string LED driver according to the second embodiment.

FIG. 6 is a block diagram of the multi-string LED driver 6-110 suitable for use as the multi-string LED driver 5-110 of FIG. 5, according to an embodiment. The multi-string LED driver 6-110 includes a multi-string control circuit 6-400 that controls first through fourth LED drivers 6-408*a* through 6-408*d*. The first through fourth LED drivers 6-408*a* through 6-408*d* are configured to control currents through first through fourth LED strings, respectively.

The multi-string control circuit 6-400 receives first through fourth dimmer signals DIM_A through DIM_D, and also receives an I2C signal I2C through I2C interface circuit 6-410. The first through fourth dimmer signals DIM_A through DIM_D each correspond to a target luminance of one or more of the first through third LED strings and may be analog signals, pulse-width modulated (PWM) signals, or multi-bit digital signals.

The I2C signal I2C may be a multi-bit digital signal corresponding to a target luminance of one or more of the first through fourth LED strings, a string control mode setting for one or more of the first through fourth LED drivers 6-408*a* through 6-408*d*, a configuration setting for the multi-string control circuit 6-400, a color curve to be stored in the multi-string control circuit 6-400, a color curve selection, and so on.

The first through fourth LED drivers 6-408*a* through 6-408*d* are configured to control the first through fourth LED strings using first through fourth string control signals SCTLA through SCTLD, according to control signals received from the multi-string control circuit 6-400 and signals received through the first through fourth current sense inputs SENSEA through SENSED, respectively.

The first through fourth LED drivers 6-408*a* through 6-408*d* control the first through fourth LED strings using a first string control mode or a second string control mode, respectively. The first string control mode varies an amplitude of a respective one of the first through fourth string control signals SCTLA through SCTLD. The second string control mode applies Pulse Width Modulation (PWM) to the respective one of the first through fourth string control signals SCTLA through SCTLD. The string control mode used by each of the first through fourth LED drivers 6-408*a* through 6-408*d* may be independently determined.

The multi-string control circuit 6-400 includes a color curve circuit 6-404 configured to produce target values for one or more of the first through fourth LED strings according to one or more dimming signals and a color curve. The target values are such that the first through fourth LED strings produce light having a luminance according to the one or more dimming signals and a CCT, which corresponds to the CCT of the color curve at the produced luminance. A target value may indicate a current for an LED string, a current ratio between LED strings, or a duty cycle of an LED string.

The color curve circuit 6-404 may be configured produce target values as described with respect to the color curve circuit 4-404 of FIG. 4.

The color curve circuit 6-404 may include one or more processors, such as one or more of a general purpose processor, a special purpose processor, and a digital signal processor, which may be used to produce the target values. The one or more processors may execute computer programming instructions stored in a non-transitory computer-readable medium.

The multi-string control circuit 6-400 provides dimming signals to the color curve circuit 6-404 and receives corresponding target values therefrom. The multi-string control circuit 6-400 controls the first through fourth LED drivers 6-408*a* through 6-408*d* according to their respective target values.

Figure 7:
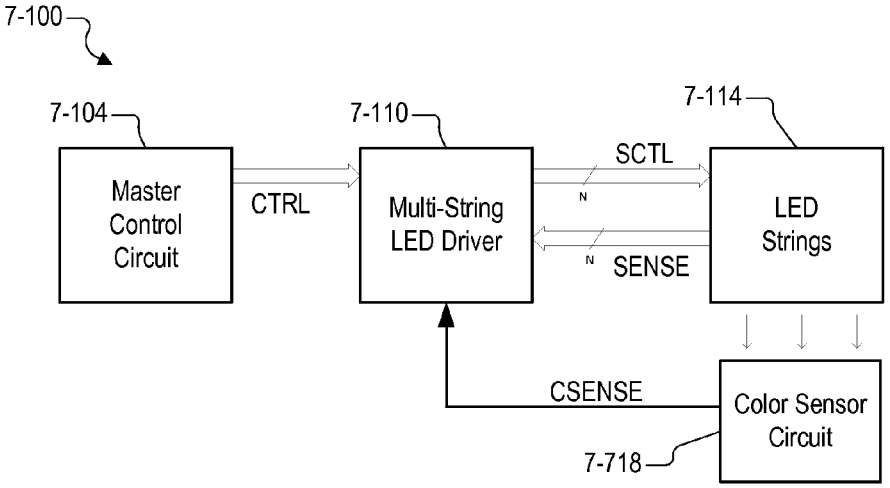
FIG. 7 is a block diagram of an LED illumination system including a multi-string LED driver according to a third embodiment.

FIG. 7 shows a LED illumination system 7-100 including a master control circuit 7-104, a plurality of LED strings 7-114, a color sensor circuit 7-718, and a multi-string LED driver 7-110 according to embodiments of the disclosure. The master control circuit 7-104 transmits master control signals CTRL to the multi-string LED driver 7-110.

The color sensor circuit 7-718 receives light generated by the LED strings 7-114 and generates a color sense signal CSENSE including color information of the received light. The color sense signal CSENSE may also include luminosity information of the received light.

The multi-string LED driver 7-110 receives the master control signals CTRL and controls currents in the plurality of LED strings 7-114 based thereon. The multi-string LED driver 7-110 modulates the currents in the plurality of LED strings 7-114 by modulating the string control signals SCTL and by sensing the current in the LED string using the current sense signals SENSE. The multi-string LED driver 7-110 modulates the string control signals SCTL by controlling a duty cycle of each of the string control signals SCTL, a magnitude of each of the string control signals SCTL, or a combination thereof.

The multi-string LED driver 7-110 also includes a color curve, and uses the color curve to control the currents in the plurality of LED strings 7-114. The color curve may indicate currents, duty cycles, or current ratios for the plurality of LED strings 7-114.

The multi-string LED driver 7-110 receives the color sense signal CSENSE from the color sensor circuit 7-718 and may modify the color curve according to the color sense signal CSENSE. The multi-string LED driver 7-110 may adjust the color curve if the color sense signal CSENSE includes color information indicating that the light output from the plurality of LED strings 7-114 does not have a color specified by the color curve. The color may correspond to a CCT.

When the color sense signal CSENSE includes luminosity information, the multi-string LED driver 7-110 may adjust the color curve if the color sense signal CSENSE includes luminance information indicating that the light output from the plurality of LED strings 7-114 does not have a luminance specified by the color curve.

Using the color sense signal CSENSE, the multi-string LED driver 7-110 may recalibrate a color curve to compensate for changes in the light produced by the plurality of LED strings 7-114 caused by one or more of manufacturing tolerances, variations in operating conditions, and the passage of time.

Figure 8:
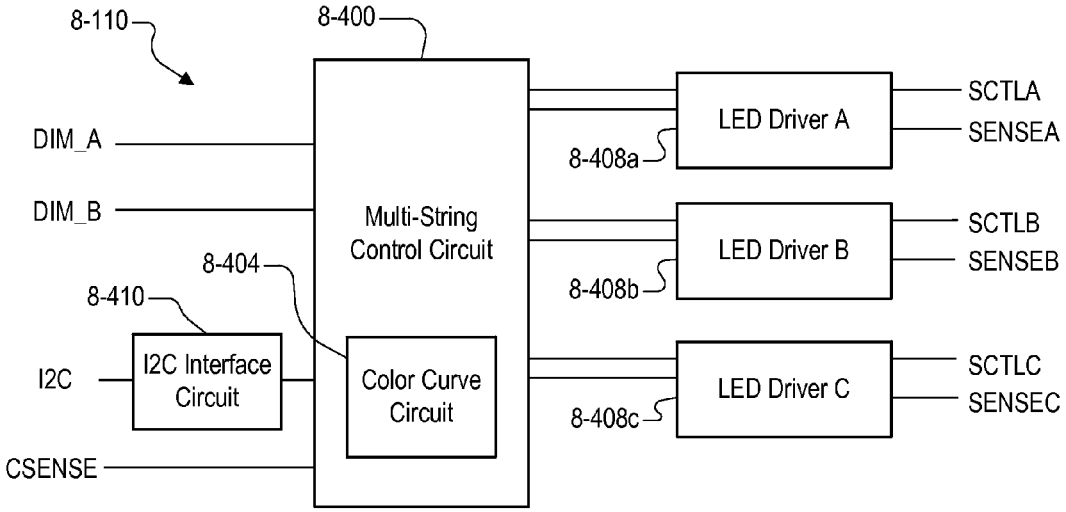
FIG. 8 is a block diagram of a multi-string LED driver according to the third embodiment.

FIG. 8 is a block diagram of a multi-string LED driver 8-110 suitable for use as the multi-string LED driver 7-110 of FIG. 7 according to an embodiment. The multi-string LED driver 8-110 includes a multi-string control circuit 8-400 that controls first through third LED drivers 8-408*a* through 8-408*c*. The first through third LED drivers 8-408*a* through

8-408*c* are configured to control currents through first through third LED strings, respectively.

The multi-string control circuit 8-400 receives a color sense signal CSENSE and first and second dimmer signals DIM_A through DIM_B. The multi-string control circuit 8-400 also receives an I2C signal I2C through an I2C interface circuit 8-410.

The first and second dimmer signals DIM_A through DIM_B each correspond to a target luminance of one or more of the first through third LED strings and may be analog signals, pulse-width modulated (PWM) signals, or multi-bit digital signals. The color sense signal CSENSE includes color information. In an embodiment, the color sense signal CSENSE also includes luminance information.

The multi-string LED driver 8-110 of FIG. 8 operates similarly to the multi-string LED driver 5-110 of FIG. 6 and provides similar functionality. In addition, the multi-string control circuit 8-400 of the multi-string LED driver 8-110 may control the first through third LED drivers 8-408*a* through 8-408*c* according to a comparison of the color information of the color sense signal CSENSE to a color curve value, and may recalibrate a color curve according to the color information of the color sense signal CSENSE. In an embodiment wherein the color sense signal CSENSE also includes luminance information, the multi-string control circuit 8-400 may control the first through third LED drivers 8-408*a* through 8-408*c* according to a comparison of the luminance information to a target luminance value, and may recalibrate a color curve according to the luminance information.

Figure 9:
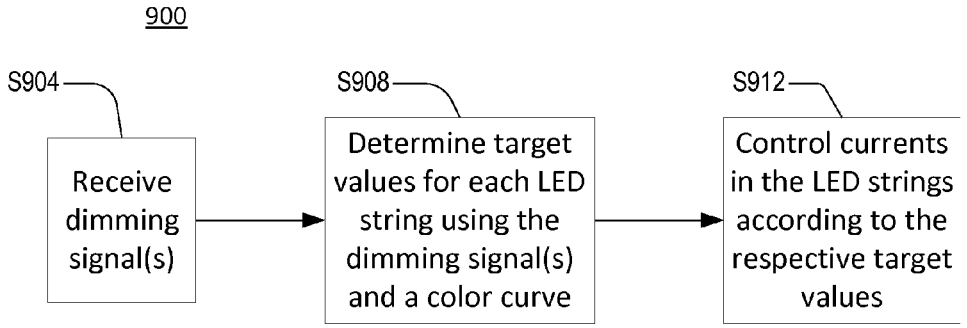
FIG. 9 is a flowchart of a process of controlling multiple LED strings according to an embodiment.

FIG. 9 is a flowchart of a process of controlling a plurality LED strings according to an embodiment. At S904, one or more dimming signals are received by a multi-string LED driver.

At S908, a target value is determined for each of a plurality of LED strings coupled to the multi-string LED driver. The target value for each LED string may be determined according to one or more of the received dimming signals or according to one or more of the received dimming signals and a color curve.

A color curve may include a current ratio between the plurality of LED strings. The current ratio may vary according to a received dimming signal. The color curve may control the plurality of LED strings to follow a black body curve, or to maintain a substantially constant CCT across a range of value for the one or more of the received dimming signals.

At S912, currents in the plurality of LED strings are controlled according to the respective target values determined for each LED string.

Aspects of the present disclosure have been described in conjunction with the specific embodiments thereof that are proposed as examples. Numerous alternatives, modifications, and variations to the embodiments as set forth herein may be made without departing from the scope of the claims set forth below. Accordingly, embodiments as set forth herein are intended to be illustrative and not limiting.

What is claimed is:

1. An apparatus, comprising:

a first LED driver configured to control a first string of LEDs;

a second LED driver configured to control a second string of LEDs;

a third LED driver configured to control a third string of LEDs; and a control circuit configured to receive a control signal and to control the first, second, and third LED drivers so that the first, second, and third strings of LEDs cooperate in producing light according to the control signal and a color curve stored in a color curve circuit of the control circuit, wherein the control circuit is configured to control each of the first and second LED drivers in a Pulse Width Modulation (PWM) mode configured to control duty cycles of currents of the respective strings of LEDs and in a linear mode configured to control magnitudes of the currents, and wherein the control circuit is operable to simultaneously control the first LED driver in the PWM mode and the second LED driver in the linear mode.

2. The apparatus of claim 1, wherein the color curve indicates light having a predetermined Correlated Color Temperature (CCT) when one or more of the strings of LEDs are dimmed.

3. The apparatus of claim 1, wherein the color curve indicates light having a Correlated Color Temperature (CCT) according to a luminance of the strings of LEDs.

4. The apparatus of claim 3, wherein the first, second, and third LED drivers are controlled so that the CCT of the luminance of the strings of LEDs substantially follows a black body curve.

5. The apparatus of claim 1, wherein the first LED driver is configured to operate a buck converter for controlling the first string of LEDs.

6. The apparatus of claim 1, further comprising:

a sensor circuit configured to sense a current of one or more of the first, second, and third strings of LEDs.

7. The apparatus of claim 1, wherein the color curve indicates ratios of currents of the first, second, and third strings of LEDs.

8. The apparatus of claim 1, wherein the control circuit is configured to receive a color sense signal and to control the first, second, and third LED drivers according to the control signal, the color curve, and the color sense signal.

9. The apparatus of claim 1, wherein a single integrated circuit includes the apparatus.

10. The apparatus of claim 1, wherein values of the color curve are stored in the color curve circuit during a calibration process or a manufacturing process.

11. The apparatus of claim 1, wherein the control circuit is configured to store, in the color curve circuit, values of a received signal as values of the color curve.

12. The apparatus of claim 1, wherein the color curve circuit is configured to select the color curve from a plurality of color curves stored in the color curve circuit.

13. A method of controlling a plurality of strings of LEDs in a multi-string LED driver, the method comprising:

receiving a control signal;

determining a target value according to the control signal and a color curve stored in a color curve circuit;

controlling an LED driver according to the target value so that the plurality of strings of LEDs cooperate in producing light according to the control signal and the color curve, wherein the LED driver is one of first through third LED drivers of the multi-string LED driver; and controlling a duty cycle of a current of a first string of LEDs of the plurality of strings of LEDs in a Pulse Width Modulation (PWM) mode, and simultaneously controlling a magnitude of a current of a second string of LEDs of the plurality of strings of LEDs in a linear mode.

14. The method of claim 13, wherein the color curve indicates light having a Correlated Color Temperature (CCT) according to the luminance of the strings of LEDs.

15. The method of claim 14, wherein the first, second, and third LED drivers are controlled so that the CCT of the luminance of the strings of LEDs substantially follows a black body curve.

16. The method of claim 13, further comprising sensing a current of one or more of the plurality of strings of LEDs and controlling the LED driver according to the sensed current.

17. The method of claim 13, further comprising receiving a color sense signal and determining the target value according to the color sense signal, the control signal, and the color curve.

18. The method of claim 13, further comprising:

receiving a data signal; and storing, in the color curve circuit, values of the data signal as values of the color curve.

19. The method of claim 13, further comprising selecting the color curve from a plurality of stored color curves that are stored in the color curve circuit.

* * * * *